US006139217A

United States Patent [19]

Reuter

[11] Patent Number: 6,139,217

[45] Date of Patent: Oct. 31, 2000

[54] CONCRETE FINISHING TOOL

[76] Inventor: Bruce W. Reuter, 19 Monroe St., Hastings, Minn. 55033

[21] Appl. No.: 09/377,411

[22] Filed: Aug. 20, 1999

[51] Int. Cl.[7] ..... E01C 19/22

[52] U.S. Cl. ..... 404/97; 404/114; 404/118

[58] Field of Search ..... 404/114, 118, 404/97; 173/217

[56] References Cited

U.S. PATENT DOCUMENTS

| | | | |
|---|---|---|---|
| 5,102,258 | 4/1992 | Berger | 404/97 |
| 5,234,283 | 8/1993 | Adkins | 404/97 |
| 5,375,942 | 12/1994 | Lindley et al. | 404/97 |
| 5,737,795 | 4/1998 | Murders | 404/118 |
| 5,984,571 | 11/1999 | Owens | 404/114 |

*Primary Examiner*—Eileen D. Lillis

*Assistant Examiner*—Raymond W Addie

[57] ABSTRACT

A concrete finishing tool comprising an elongated handle in a cylindrical configuration having an upper portion and a lower portion and an intermediate portion there between, the upper portion having a lower end and an upper end with the upper portion containing a battery, the lower portion having a lower end with a horizontal aperture there through and an upper end, the intermediate portion having a lower end and an upper end with the intermediate portion containing a switch with a receiver adjacent to its upper end and an axially reciprocating vibrator adjacent to its lower end and with a motor there between; and a cross piece with lateral ends and with a planar lower surface adapted to finish concrete and an upper surface with a central bracket formed with a horizontal aperture there through and with a pin pivotally coupling the bracket to the lower end of the handle, the upper surface also including a pair of vibrators adjacent to the lateral ends thereof.

4 Claims, 3 Drawing Sheets

CONCRETE FINISHING TOOL

BACKGROUND OF THE INVENTION

1. Field of the Invention

The present invention relates to a new and improved concrete finishing tool and, more particularly, pertains to providing vibratory and remote control capabilities to a concrete finishing tool.

2. Description of the Prior Art

The use of concrete finishers of known designs and configurations is known in the prior art. More specifically, concrete finishers of known designs and configurations heretofore devised and utilized for the purpose of finishing concrete by known methods and apparatuses are known to consist basically of familiar, expected, and obvious structural configurations, notwithstanding the myriad of designs encompassed by the crowded prior art which has been developed for the fulfillment of countless objectives and requirements.

The prior art discloses a large number of concrete finishers of known designs and configurations. By way of example, U.S. Pat. No. 5,234,283 to Adkins discloses a vibratory concrete float apparatus.

U.S. Pat. No. 5,632,569 to Szmansky discloses a cement finishing hand tool.

U.S. Pat. No. 5,540,529 to Weber discloses a portable vibratory wet screed.

U.S. Pat. No. Des. 324,980 to Owens discloses a bull float.

U.S. Pat. No. Number 2,400,341 to Day et al. discloses a vibrating hand trowel.

Lastly, PCT Application WO 82/02166 to Ishihara discloses a method and apparatus for placing concrete.

In this respect, the concrete finishing tool according to the present invention substantially departs from the conventional concepts and designs of the prior art, and in doing so provides an apparatus primarily developed for the purpose of Providing vibratory and remote control capabilities to a concrete finishing tool.

Therefore, it can be appreciated that there exists a continuing need for a new and improved concrete finishing tool which can be used for Providing vibratory and remote control capabilities to a concrete finishing tool. In this regard, the present invention substantially fulfills this need.

SUMMARY OF THE INVENTION

In view of the foregoing disadvantages inherent in the known types of Concrete finishers of known designs and configurations now present in the prior art, the present invention provides a new and improved concrete finishing tool. As such, the general purpose of the present invention, which will be described subsequently in greater detail, is to provide a new and improved concrete finishing tool and methods which have all the advantages of the prior art and none of the disadvantages.

To attain this, the present invention essentially comprises a new and improved concrete finishing tool with electrical vibrating and remote control capabilities comprising, in combination an elongated handle in a cylindrical configuration having an upper portion and a lower portion and an intermediate portion there between, the upper portion having a lower end with electrically conductive male threads and an electrically conductive center and an upper end with electrically conductive female threads and an electrically conductive center with the upper portion containing a rechargeable 12 volt nickel-cadmium battery adapted to be recharged, the lower portion having a lower end with a horizontal aperture there through and an upper end with electrically conductive female threads and an electrically conductive center, the intermediate portion having a lower end with electrically conductive male threads and an electrically conductive center and an upper end with electrically conductive female threads and an electrically conductive center with the intermediate portion containing a rubber sealed switch with a receiver and current limiter adjacent to its upper end and an axially reciprocating vibrator adjacent to its lower end and with a 12 volt motor there between; a cross piece with lateral ends and with a planar lower surface adapted to finish concrete and an upper surface with a central bracket formed with a horizontal aperture there through and with a pin pivotally coupling the bracket to the lower end of the handle, the upper surface also including a pair of rotary vibrators with motors adjacent to the lateral ends thereof; an electrical recharging component having an input member adapted to receive electrical power from a vehicle battery and an output lower end with electrically conductive male threads and an electrically conductive center adapted to be releasably coupled to the upper end of the upper portion for recharging purposes; and a remote control mechanism with a belt clip and having a transmitter and controller operably couplable to the switch with speed controls therewith to selectively provide and preclude electrical power from the battery to the motor, the power from the battery and motor including wires adapted to concurrently power the vibrator in the handle as well and the vibrators on the upper surface of the crosspiece.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved concrete finishing tool which has all the advantages of the prior art Concrete finishers of known designs and configurations and none of the disadvantages.

It is another object of the present invention to provide a new and improved concrete finishing tool which may be easily and efficiently manufactured and marketed.

It is a further object of the present invention to provide a new and improved concrete finishing tool which is of a durable and reliable construction.

An even further object of the present invention is to provide a new and improved concrete finishing tool which is susceptible of a low cost of manufacture with regard to both materials and labor, and which accordingly is then susceptible of low prices of sale to the consuming public, thereby making such a concrete finishing tool economically available to the buying public.

Even still another object of the present invention is to Providing vibratory and remote control capabilities to a concrete finishing tool.

Lastly, it is an object of the present invention to provide a concrete finishing tool comprising an elongated handle in a cylindrical configuration having an upper portion and a lower portion and an intermediate portion there between, the upper portion having a lower end and an upper end with the upper portion containing a battery, the lower portion having a lower end with a horizontal aperture there through and an upper end, the intermediate portion having a lower end and an upper end with the intermediate portion containing a switch with a receiver adjacent to its upper end and an axially reciprocating vibrator adjacent to its lower end and with a motor there between; and a cross piece with lateral ends and with a planar lower surface adapted to finish concrete and an upper surface with a central bracket formed with a horizontal aperture there through and with a pin pivotally coupling the bracket to the lower end of the handle, the upper surface also including a pair of vibrators adjacent to the lateral ends thereof.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various Figures.

DESCRIPTION OF THE PREFERRED EMBODIMENT

Figure 1:
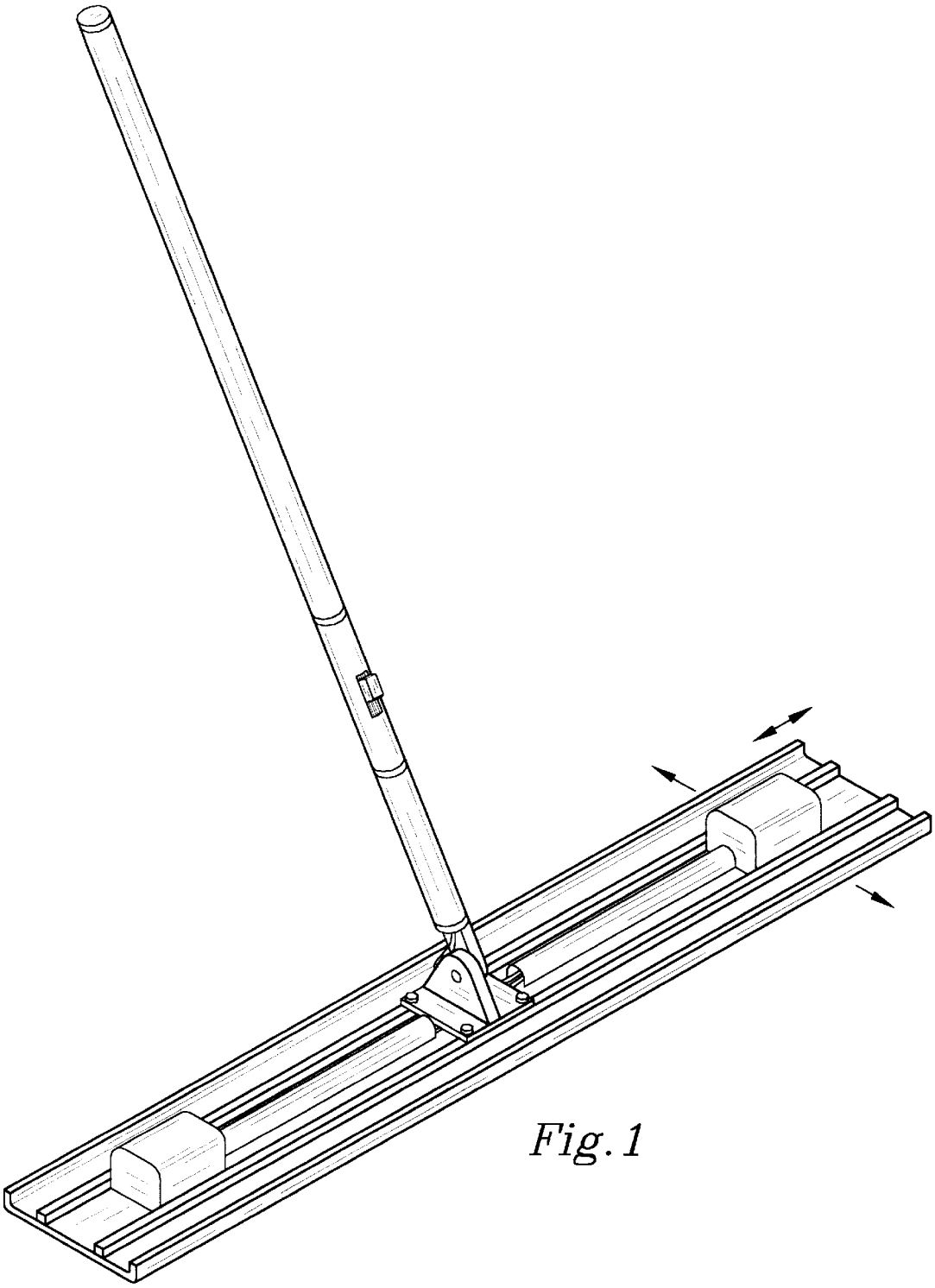
FIG. 1 is a perspective illustration of the preferred embodiment of the concrete finishing tool constructed in accordance with the principles of the present invention.
Figures 2, 3, 4, 5, 6:
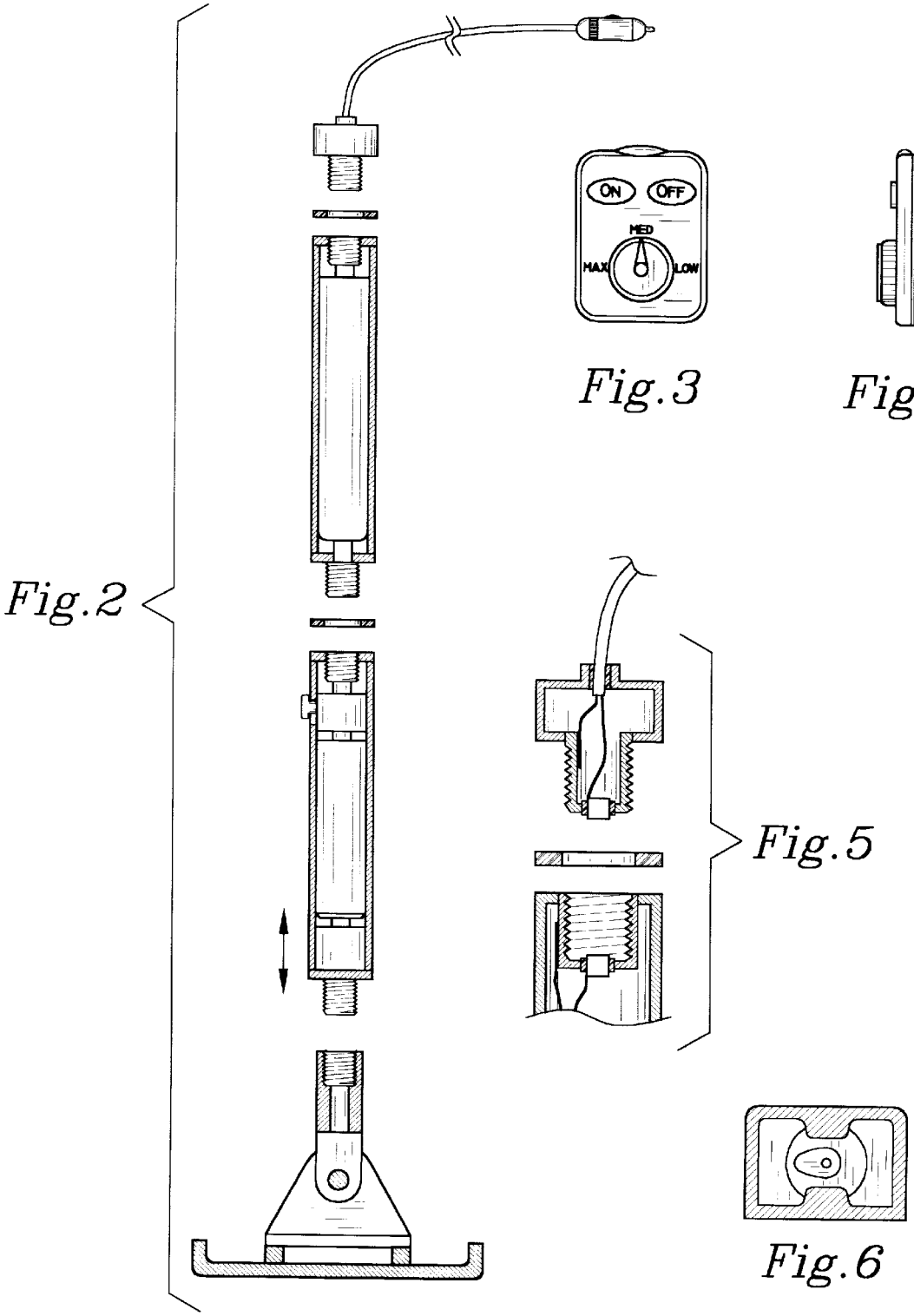
FIG. 2 is an exploded sectional view of the tool shown in FIG. 1.
FIG. 3 is a front elevational view of the remote control mechanism.
FIG. 4 is a side elevational view of the remote control mechanism of FIG. 3.
FIG. 5 is a cross sectional view of the top most coupling components.
FIG. 6 is a cross sectional view of a vibrator and motor on the cross member.
Figure 7:
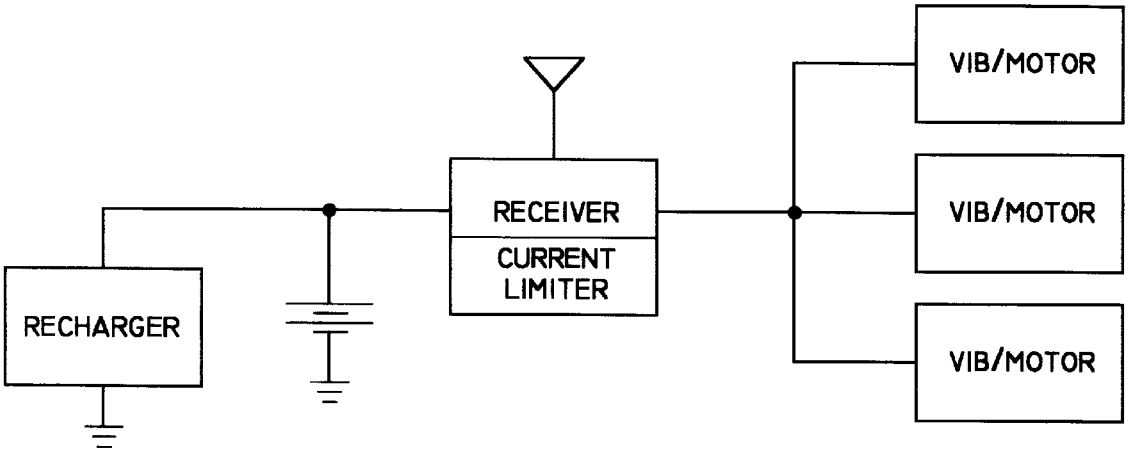
FIGS. 7 and 8 are electrical schematics of the tool of the prior Figures.
Figure 8:
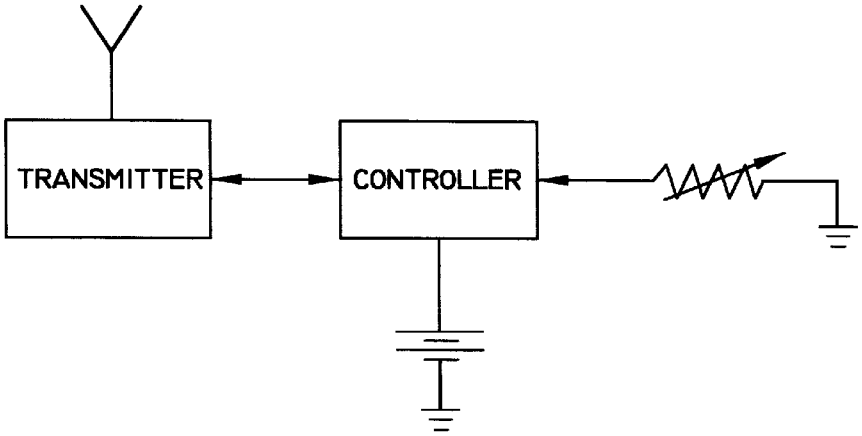

With reference now to the drawings, and in particular to FIGS. 1 through 8 thereof, the preferred embodiment of the new and improved concrete finishing tool embodying the principles and concepts of the present invention and generally designated by the reference numeral 10 will be described.

The present invention, the new and improved concrete finishing tool is a system 10 comprised of a plurality of components. Such components, in their broadest context, include a an elongated handle, a cross piece, an electrical recharging component and a remote control mechanism. Each of the individual components is specifically configured and correlated one with respect to the other so as to attain the desired objectives.

The first component of the concrete finishing tool 10 of the present invention is an elongated handle 14. The handle is formed in a cylindrical configuration. It has an upper portion 16 and a lower portion 18 and an intermediate portion 20 there between. The upper portion has a lower end with electrically conductive male threads 22 and an electrically conductive center 24. The upper end has electrically conductive female threads 26 and an electrically conductive center 28. The upper portion contains a rechargeable 12 volt nickel-cadmium battery 30 which is adapted to be recharged.

The lower portion has a lower end with a horizontal aperture 32 there through. It also has an upper end with electrically conductive female threads 34 and an electrically conductive center 36. The intermediate portion has a lower end with electrically conductive male threads 38 and an electrically conductive center 40. It also has an upper end with electrically conductive female threads 42 and an electrically conductive center 44. The intermediate portion contains a rubber sealed switch 46 with a receiver and current limiter adjacent to its upper end and an axially reciprocating vibrator 48 adjacent to its lower end and with a 12 volt motor 50 there between. The various male and female threads of the above-described portions uncouple with respect to each other to separate the components for storage and transportation. Note FIG. 2. They also couple with respect to each other to allow for assembly and forming electrical couplings there between during operation and use. Note FIG. 1.

Next provided is a cross piece 54 with lateral ends and with a planar lower surface adapted to finish concrete. The cross piece also has an upper surface with a central bracket 56 formed with a horizontal aperture 58 there through. A pin 60 pivotally couples the bracket to the lower end of the handle. The upper surface also includes a pair of rotary vibrators 62 with motors 64 adjacent to the lateral ends thereof.

An electrical recharging component 68 in also provided. Such component has an input member 70 adapted to receive electrical power from a vehicle battery or the like. It also has an output lower end with electrically conductive male threads 72 and an electrically conductive center 74 adapted to be releasably coupled to the upper end of the upper portion. This is for recharging purposes.

Lastly provided is a remote control mechanism 78. Such mechanism includes a belt clip 80. Such mechanism also includes a transmitter and controller operably couplable to the switch with speed controls 82 therewith. This functions to selectively provide and preclude electrical power from the battery to the motor, the power from the battery and motor. Also included are wires adapted to concurrently power the vibrator in the handle as well and the vibrators on the upper surface of the crosspiece. In association therewith rubber washers are preferably employed at the couplings for the various portions of the tool.

The present invention is a concrete finishing tool designed to provide improvement over the conventional tool known as a "bull float". The present invention provides vibration to the blade, for the purpose of helping to bring the "cream" to the surface for an easier "finish".

The present invention shall have a battery power system enclosed within the handle. A 12-volt Ni-Cad battery is preferred. An On/Off switch shall be mounted near the top of the handle. The battery may be charged through connection to a vehicle's cigarette lighter plug; the cord connector shall be provided at the top of the handle. In this manner, recharging will always be conveniently available at any work site.

Two vibrating motors shall be mounted upon the top of the blade, one on each side of the handle, positioned so as to be evenly balanced. Enclosed wiring shall lead from the handle along the top of the blade to the motors. A variable speed system may also be incorporated for adjusting the degree of vibration as desired.

The present invention allows pours to be made at a lower slump, which is always desirable to produce greater strength in the finished concrete which is desirable for many Federal and State job applications.

The design concept may be applied to a variety of other concrete finishing tools, such as: chutes, edgers, hand floats, screeds, and cutters.

The present invention may be designed to include a remotely operated On/Off system that would be controlled by a unit tht could be worn on the operator's belt.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved concrete finishing tool with electrical vibrating and remote control capabilities comprising, in combination:

an elongated handle in a cylindrical configuration having an upper portion and a lower portion and an intermediate portion there between, the upper portion having a lower end with electrically conductive male threads and an electrically conductive center and an upper end with electrically conductive female threads and an electrically conductive center with the upper portion containing a rechargeable 12 volt nickel-cadmium battery able to be recharged, the lower portion having a lower end with a horizontal aperture there through and an upper end with electrically conductive female threads and an electrically conductive center, the intermediate portion having a lower end with electrically conductive male threads and an electrically conductive center and an upper end with electrically conductive female threads and an electrically conductive center with the intermediate portion containing a rubber sealed switch with a receiver and current limiter adjacent to its upper end and an axially reciprocating vibrator adjacent to its lower end and with a 12 volt motor there between;

a cross piece with lateral ends and with a planar lower surface able to finish concrete and an upper surface with a central bracket formed with a horizontal aperture there through and with a pin pivotally coupling the bracket to the lower end of the handle, the upper surface also including a pair of rotary vibrators with motors adjacent to the lateral ends thereof;

an electrical recharging component having an input member adapted to receive electrical power from a vehicle battery and an output end lower end with electrically conductive male threads and an electrically conductive center is adapted to be releasably coupled to the upper end of the upper portion for recharging purposes; and a remote control mechanism with a belt clip and having a transmitter and controller operably couplable to the switch with speed controls therewith to selectively provide and preclude electrical power from the battery to the motor, the power from the battery and motor including wires able to concurrently power the vibrator in the handle as well and the vibrators on the upper surface of the crosspiece.

2. A concrete finishing tool comprising:

an elongated handle in a cylindrical configuration having an upper portion and a lower portion and an intermediate portion there between, the upper portion having a lower end and an upper end with the upper portion containing a battery, the lower portion having a lower end with a horizontal aperture there through and an upper end, the intermediate portion having a lower end and an upper end with the intermediate portion containing a switch with a receiver adjacent to its upper end and an axially reciprocating vibrator adjacent to its lower end and with a motor there between; and a cross piece with lateral ends and with a planar lower surface adapted to finish concrete and an upper surface with a central bracket formed with a horizontal aperture there through and with a pin pivotally coupling the bracket to the lower end of the handle, the upper surface also including a pair of vibrators adjacent to the lateral ends thereof.

3. The tool as set forth in claim 2 and further including:

an electrical recharging component having an input member able to receive electrical power from a vehicle battery and an output member able to be releasably coupled to the upper portion for recharging purposes.

4. The tool as set forth on claim 2 and further including:

a remote control mechanism and having a transmitter and controller operably couplable to the switch with speed controls therewith to selectively provide and preclude electrical power from the battery to the motor, the power from the battery and motor including wires adapted to concurrently power the vibrator in the handle as well and the vibrators on the upper surface of the crosspiece.

* * * * *